US005557374A

United States Patent [19]

Chen

[11] Patent Number: 5,557,374

[45] Date of Patent: Sep. 17, 1996

[54] CONTACT CHARGER HAVING A SELECTED PERPENDICULAR RESISTIVITY

[75] Inventor: Ding-Yu Chen, Inuyama, Japan

[73] Assignee: Brother Kogyo Kabushiki Kaisha, Nagoya, Japan

[21] Appl. No.: 429,720

[22] Filed: Apr. 27, 1995

[30] Foreign Application Priority Data

Apr. 28, 1994 [JP] Japan ..... 6-092129

[51] Int. Cl.[6] ..... G03G 15/02

[52] U.S. Cl. ..... 355/219; 361/225

[58] Field of Search ..... 355/219; 361/225; 430/902

[56] References Cited

U.S. PATENT DOCUMENTS 4,371,252 2/1983 Uchida et al. ..... 355/219

5,384,626 1/1995 Kugoh et al. ..... 355/219

*Primary Examiner*—Joan H. Pendegrass
*Assistant Examiner*—Quana Grainger
*Attorney, Agent, or Firm*—Kane, Dalsimer, Sullivan, Kurucz, Levy, Eisele and Richard, LLP

[57] ABSTRACT

To provide a highly reliable contact type charge unit capable of a creating a uniform charge on a photosensitive layer, a charging member of the charge unit which contacts the photosensitive layer is made from a material having a perpendicular resistivity in a range of between $10^3$ to $10^8\Omega$. The perpendicular resistivity is defined by a product of a surface resistivity of the charging member and square of the thickness of the charging member in the current flowing direction.

11 Claims, 4 Drawing Sheets

CONTACT CHARGER HAVING A SELECTED PERPENDICULAR RESISTIVITY

BACKGROUND OF THE INVENTION

1. Field of the Invention

The present invention relates to a charge unit, and more particularly to a contact charge unit used in electrophotographic image-forming devices such as laser printers, photocopy machines, and a facsimile machines.

2. Description of the Related Art

Typically, charge units are used for charging a photosensitive member in an electrophotographic device. The charge units can be categorized into contact and non-contact types. Contact type charge units require a lower energization voltage and generate less ozone than do non-contact types.

Japanese Laid-Open Patent Publication (Kokai) No. HEI-2-282280 discloses a contact type charge unit as shown in FIG. 1. The charge unit includes a resiliently deformable resistor member 61 that is urged against the peripheral surface of a photosensitive drum 69 by a cantilever made from leaf spring 62. The photosensitive drum 69 is formed from an aluminum tube 68 coated with a photosensitive layer 67 on the peripheral outer surface thereof. The resistor member 61 is made from urethane rubber, acrylonitrile-butadiene rubber (NBR), or other suitable material. The leaf spring 62 is made from approximately 100 micrometer thick stainless steel whose one end is fixed to a conductive support member 63 by a screw 65. A pressing member 64 is provided so as to force the leaf spring 62 toward the photosensitive layer 67 of the drum 69 so that the resilient resistor member 61 presses against the photosensitive layer 67. A power source 66 is connected to the support member 63 by an electrical wire.

In such a conventional contact type charge unit, it has proven difficult to apply a uniform voltage to the resistor member 61. Attempts have been made to solve this problem, such as applying an AC current or providing a multi-layer resistor member, but these result in a more complex configuration.

SUMMARY OF THE INVENTION

It is an object of the present invention to overcome the above-described problem and to provide a highly reliable contact type charge unit capable of a creating a uniform charge.

In order to achieve the above and other objects, there is provided a contact charger which includes a charging member for applying a voltage to a body to be charged in contact with said charging member. When the voltage is applied to the body to be charged, a charging current flows in the charging member in a direction toward the body to be charged. The charging member has a thickness in the current flowing direction. In accordance with the invention, the charging member has a perpendicular resistivity whose order is in a range of between $10^3$ to $10^8\Omega$. The perpendicular resistivity is defined by a product of a surface resistivity of the charging member and square of the thickness of the charging member. Preferably, the perpendicular resistivity is selected to have an order of $10^5\Omega$.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Contact charge units according to preferred embodiments of the present invention will be described while referring to the accompanying drawings.

Figure 1:
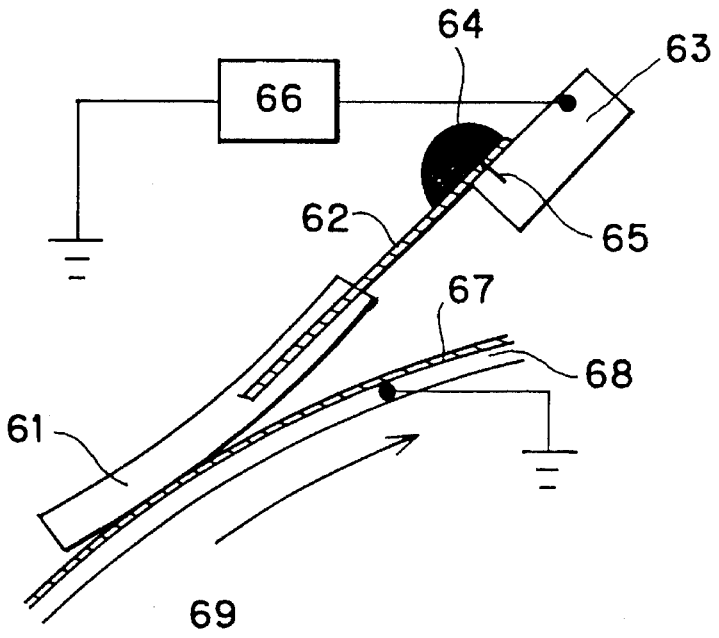
FIG. 1 PRIOR ART
FIG. 1 is a cross-sectional view showing a conventional contact charge unit.
Figure 2A:
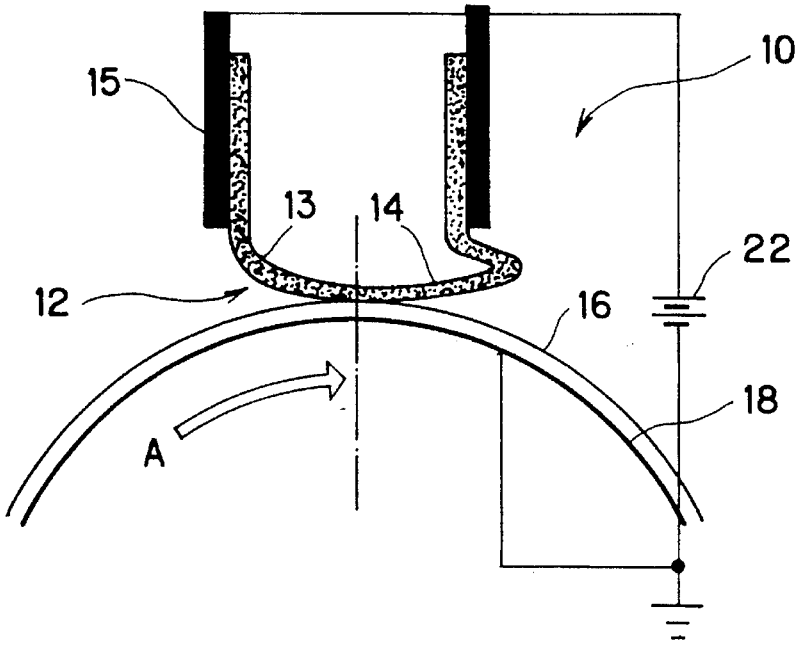
FIG. 2A is a cross-sectional view showing a contact charge unit according to a first embodiment of the present invention.

FIG. 2A shows the contact charge unit according to a first embodiment of the invention. As shown therein, the contact charge unit 10 includes a charger member 12, a conductor member 15, and power source 22. The charger member 12 is formed by folding a highly resilient plate into a shape having a generally U-shaped cross-section. The charger member 12 includes a metal layer 14 and a resistor layer 13 deposited over the entire surface of the metal layer 14. The metal layer 14 is connected to the power source 22 via the conductor member 15. The conductor member 15 fixedly supports the charger member 12 so that the charger member 12 contacts the photosensitive layer 16. This configuration and the resiliency of the charger member 12 insures that the charger member 12 deforms in conformity with the irregularities in the surface of the photosensitive layer 16, thereby maintaining uniform abutment between the resistor layer 13 of the charger member 12 and the photosensitive layer 16. The power source 22 supplies a DC voltage to the charger body 12.

Figure 3:
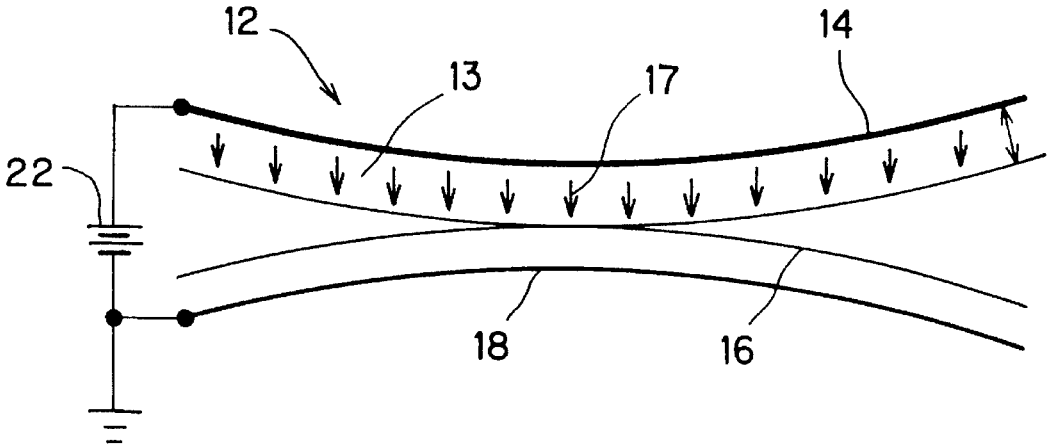
FIG. 3 is a partially enlarged cross-sectional view of FIG. 2.

FIG. 3 is an enlarged diagram showing a part of the charge unit 10 in which the charger member 12 is in contact with the photosensitive layer 16. The charger member 12 includes a resistor layer 13 made from an approximately 100 micrometer thick polyimide tube in which is dispersed carbon; and an approximately 0.3 micrometer thick copper metal layer 14 accumulated on the surface of the resistor layer 13 opposite to the surface that contacts the photosensitive layer 16. A current flows through the charger member 12 in the direction indicated by arrows 17.

The photosensitive layer 16 is coated on the peripheral surface of an aluminum drum 18. The drum 18 is connected to ground and serves as an electrode. The photosensitive layer 16 is formed from an organic photo conductor (OPC), amorphous silicon, selenium, or other suitable material. In this embodiment, the photosensitive layer 16 is an approximately 20 micrometer thick layer of OPC.

In operation, the photosensitive drum is rotated in the direction indicated by the arrow A in FIG. 2A at a speed of, for example, 47 mm/sec. A DC voltage is applied between the metal layer 14 and the aluminum electrode 18 by the power source 22 so that a voltage is developed between the metal layer 14 and the aluminum electrode 18 via the resistor layer 13 and the photosensitive layer 16. Therefore, the surface of the photosensitive layer 16 is charged either through charge injection where the resistor layer 13 contacts the photosensitive layer 16 or through discharge where spatial gaps are formed between the two. In the latter case, because the resistor layer 13 prevents a large current from flowing between the metal layer 14 and the aluminum electrode 18, sparks or ark discharges do not occur therebetween but stable corona discharges occur.

Because the charge unit of the present embodiment does not use a leaf spring as used in conventional charge units, the charger member 12 can be made extremely thin. As a result, the charger member 12 easily deforms to contours of the photosensitive layer 16, uniform contact can be maintained between the resistor layer 13 and the photosensitive layer 16, and unevenness in charge on the photosensitive layer 16 can be reduced. Further, uniform contact can be maintained even when the charger member 12 is pressed against the photosensitive layer 16 with less force than conventionally used. As a result, both the photosensitive layer 16 and the resistor layer 13 receive less pressure so that the life of the photosensitive layer 16 and the resistor layer 13 is prolonged.

However, when the resistor layer 13 has a small resistivity, abnormal discharges will occur, thereby causing the photosensitive layer 16 to non-uniformly charge. On the other hand, a large resistivity of the resistor layer 13 can prevent complete charge of the photosensitive layer 16, thereby resulting in defects in printed images. Therefore, it is a key point for the resistive layer 16 to have an appropriate resistivity to insure uniform charge. There have been attempts to set the range of resistivity in non-contact type chargers (as opposed to the contact type charger of the present invention). For example, Japanese Patent B2 Publication (Kokoku) No. SHO-62-296174 describes a resistivity of $10^6\Omega\times$cm through $10^{13}\Omega\times$cm. Japanese Patent B2 Publication (Kokoku) No. HEI-1-292358 describes a resistivity of $1\Omega\times$cm through $10^{10}\Omega\times$cm. The reason that the range of resistivity said to be optimum in these references varies greatly would be the use of volume resistivity in evaluating the charge condition of the photosensitive layer without concern for the electrode configuration.

In the present embodiment, the resistivity pn (hereinafter referred to as "perpendicular resistivity") defined by the product of the surface resistivity and the square of the thickness will be used in evaluating sheet electrode. The relation between the numeric value of the perpendicular resistivity, surface resistivity, and the volume resistivity can be expressed as follows:

$$pn=ps\times t^2=pv\times t$$

wherein ps is the surface resistivity, pv is the volume resistivity, and t is the thickness of the material (sheet electrode) in which direction a current flows. The surface resistivity ps represents a resistivity on the surface of a material to be measured. The unit of the surface resistivity ps is expressed in ohms and is given by measuring the resistance between two opposing side surfaces of a square shape surface on the material to be measured. The volume resistivity pv is expressed in $\Omega\cdot$cm and represents a resistivity not related to the shape of the material to be measured. The perpendicular resistivity pn takes into account the thickness of the material related to the current flowing direction. The perpendicular resistivity pn substantially controls the flow of charge current.

Next, evaluation of printed results in relation to the perpendicular resistivity will be made. Printing was performed using sheet electrodes with differing perpendicular resistivity pn to charge the photosensitive layer 16. Printed images were evaluated visually and with an evaluation device in a manner described below.

In order to realize the optimum conditions for uniform charge, strict and quantitative evaluations of print are necessary. The print pattern evaluated was horizontal lines separated by double spaces. The width of each printed lines was measured using a print evaluation device. Print quality was evaluated according to the standard deviation in width of printed lines. Lines with a large standard deviation in width result when the electrode used during printing produces a poorly uniform charge at the surface of the photosensitive drum. Contrarily, lines with a small standard deviation in line width indicate that the electrode used during printing produced a uniform charge on the surface of the photosensitive drum. This method allows judging the relative quality of printed images.

Figure 4:
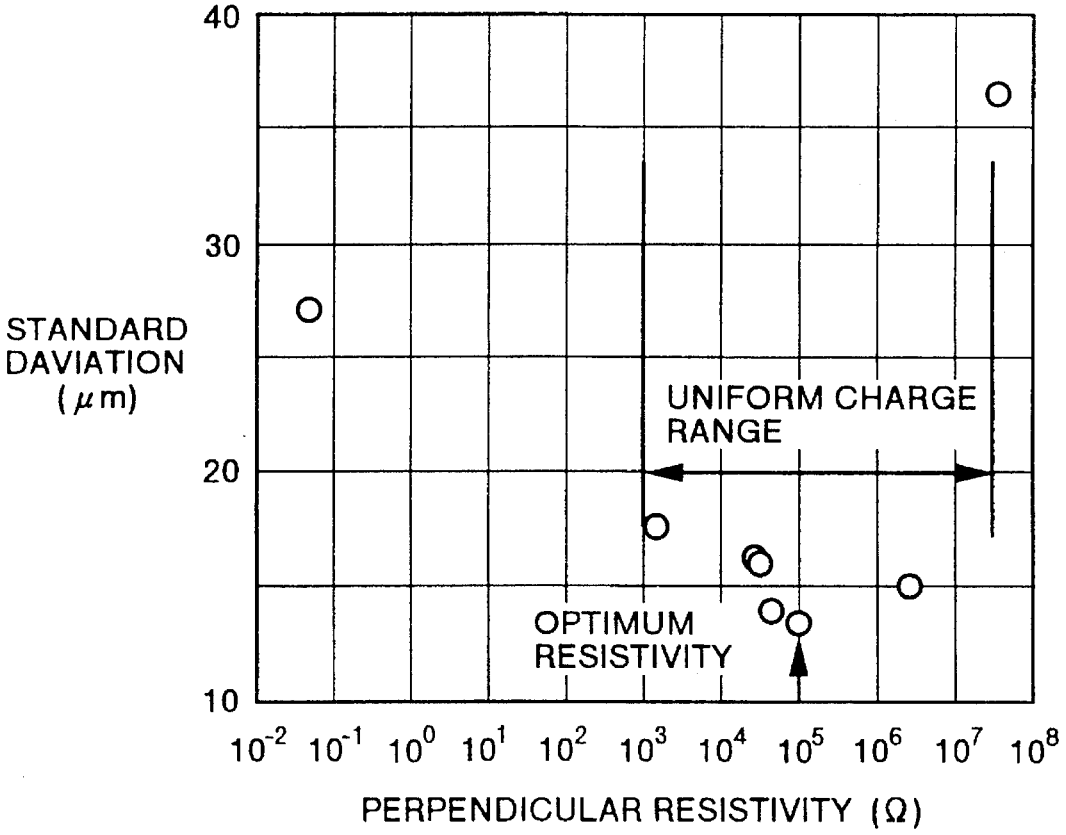
FIG. 4 is a diagram illustrating a relationship between perpendicular resistivity and standard deviation.

Sheet electrodes with differing perpendicular resistivity were evaluated and the results of the evaluations plotted into the graph shown in FIG. 4. Sheet electrodes with perpendicular resistivity within the range of $10^3\Omega$ and $10^8\Omega$ resulted in printed lines with the smallest standard deviation in width, that is, about 20 micrometers or less. The homogeneity of print could also be visually recognized. Sheet electrodes with perpendicular resistivity outside this range resulted in printed lines with a large standard deviation in width, that is, about 25 micrometers or more.

Visual evaluations agreed with evaluations performed using the print evaluation device. That is, sheet electrodes with perpendicular resistivity of less than $10^3\Omega$ (i.e., an excessively low perpendicular resistivity) produced uneven images and sheet electrodes with perpendicular resistivity of greater than or equal to $10^8\Omega$ (i.e., an overly high perpendicular resistivity) produced black images from defective charge. Accordingly, the range of perpendicular resistivity suitable for generating a uniform charge is between $10^3\Omega$ to $10^8\Omega$. Further, as shown in FIG. 4, sheet electrode with perpendicular resistivity of about $10^5\Omega$ resulted in lines with the smallest standard deviation in width (i.e., 13.6 micrometers). Accordingly, the optimum resistivity capable of producing uniform charge is about $10^5\Omega$.

Figure 5:
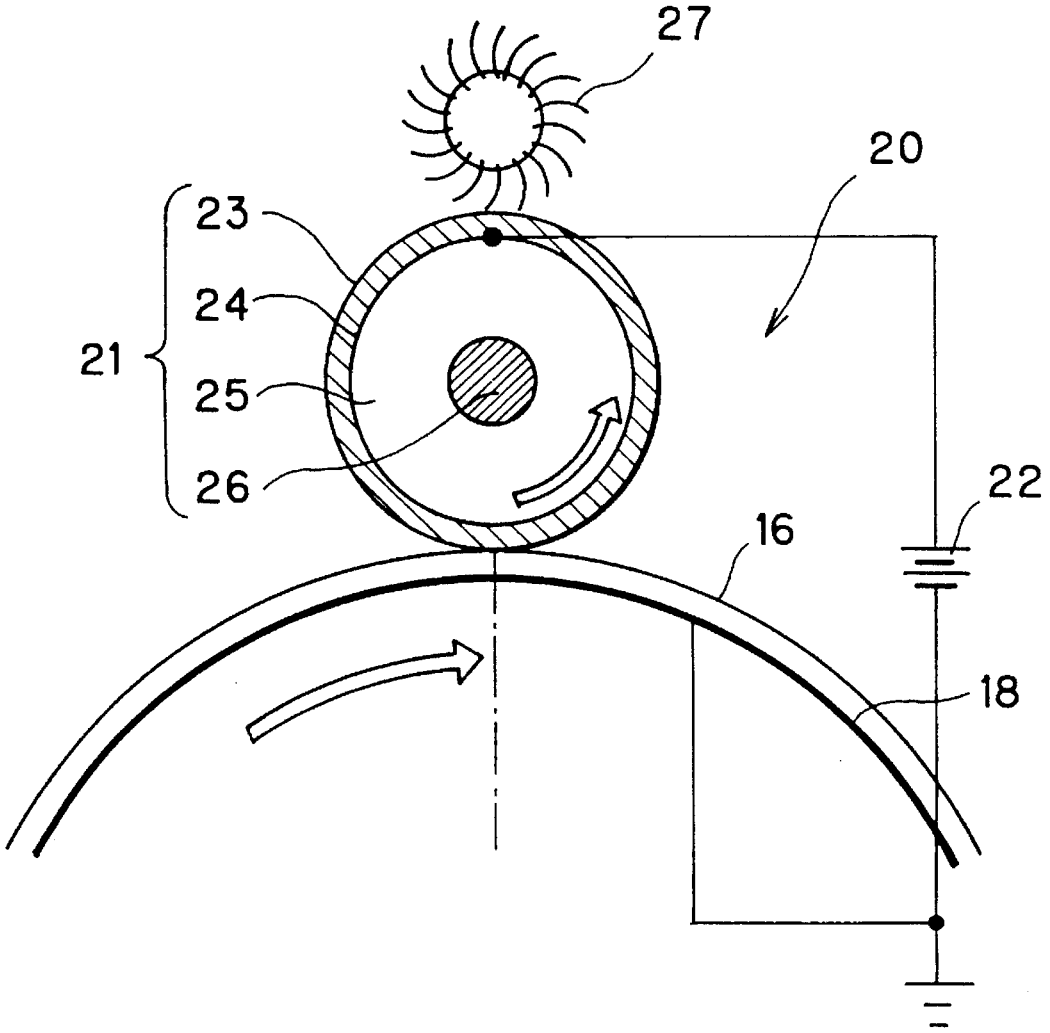
FIG. 5 is a cross-sectional view showing a contact charge unit according to a second embodiment of the present invention.

The present invention can also be applied to a contact charger 20 as shown in FIG. 5. The contact charger 20 shown therein includes a resistor layer 23 formed on the outer peripheral surface of a roller-shaped charger member 21, a metal layer 24 serving as a electricity-supplying metal layer for supplying electricity from the inner perimeter of the resistor layer 23, insulation layer 25 made of sponge and supporting the roller-shaped charger member 21 relative to the photosensitive layer 16, and a metal core 26. The photosensitive drum has a photosensitive layer 16 formed over the peripheral surface of an aluminum tube electrode 18. A power source 22 is connected to the metal layer 24. A cleaning member 27 is provided for removing foreign matter, such as toner particles, dust, and dirt clinging to the resistor layer 23 of the roller-shaped charger member 21. With this structure the roller-shaped charger member 21 deforms in accordance with unevenness on the surface of the photosensitive layer 16 when pressed against the photosensitive layer 16. In this way, uniform contact is maintained between the photosensitive layer 16 and the resistor layer 23 of the roller-shaped charger member 21. The material and the thickness of the resistor layer 23 are selected and determined so that the perpendicular resistivity of the resistor layer 16 falls in a range between $10^3\Omega$ to $10^8\Omega$.

The contact charger shown in FIG. 5 operates by the same principles as that of the first embodiment. The charge member is rotated by rotation of the roller-shaped photosensitive drum, resulting in the entire surface of charge member 21 contacting the photosensitive layer 16 with each rotation of the charge member 21. Since the entire surface of the charger member 21 is used to produce a charge on the photosensitive layer 16, rather than only a specific region as in the case of the fixed charger 12 shown in FIG. 2A, the charger member 21 can be expected to have a longer life. Further, the cleaning member 27 is easily installed. The cleaning member 27 continuously removes foreign matter picked up by the charger member 21 from contact with the photosensitive layer 16. The charger member 21 in FIG. 5 can even more reliably provide a uniform charge.

The present invention provides a contact charger with a simpler construction, that produces a more reliable and more uniform charge, and that has a longer life than conventional contact chargers.

While the invention has been described in detail with reference to specific embodiments thereof, it would be apparent to those skilled in the art that various changes and modifications may be made therein without departing from the spirit of the invention, the scope of which is defined by the attached claims.

Figure 2B:
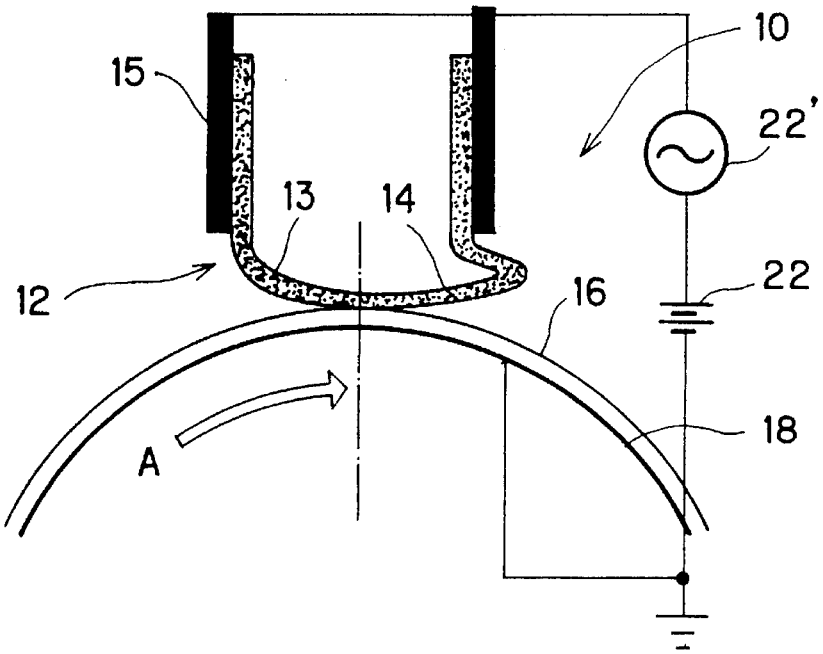
FIG. 2B is a view similar to FIG. 2A showing a modified contact charge unit.

For example, the energization voltage was described as a DC voltage. However, as shown in FIG. 2B AC voltage produced from AC power source 22' may be superimposed on the DC voltage and the thus produced superimposed voltage may be used to energize the charger unit. Additionally, the charge member is not limited to the sheet-shaped or roller-shaped member as described, but could also be a, belt-or, blade-shaped member as long as the resistivity of the charge member in the direction of the flow of the charge current is within the range of $10^3$ to $10^8\Omega$ and more desirably $10^5\Omega$.

What is claimed is:

1. A contact charger comprising:

a charging member for applying a voltage to a body to be charged in contact with said charging member, a charging current flowing in said charging member in a direction toward the body to be charged, wherein said charging member being formed as a sheet and having a thickness in the current flowing direction has a perpendicular resistivity whose order is in a range of between $10^3$ to $10^8\Omega$, wherein the numerical value of the perpendicular resistivity is given by a product of a surface resistivity of said charging member and a square of the thickness of said charging member.

2. A contact charger according to claim 1, wherein said charging member has the perpendicular resistivity whose order is $10^5\Omega$.

3. A contact charger according to claim 1, wherein said charging member comprises a resilient plate folded into a shape having a generally U-shaped cross-section.

4. A contact charger according to claim 3, wherein said resilient plate is a multi-layer structure comprising a metal layer and a resistor layer, said resistor layer being in contact with the body to be charged and having the perpendicular resistivity whose order is in the range of between $10^3$ to $10^8\Omega$.

5. A contact charger according to claim 4, wherein said charging member further comprises an electrically conductive member for supporting said resilient plate and for applying the voltage to said resistor layer.

6. A contact charger according to claim 5, further comprising a power source for supplying the voltage to said electrically conductive member.

7. A contact charger according to claim 6, wherein said power source supplies a DC voltage to said electrically conductive member.

8. A contact charger according to claim 6, wherein said power source supplies a DC voltage and an AC voltage superimposed on the DC voltage.

9. A contact charger according to claim 3, wherein said metal layer is made from copper having a thickness of approximately 0.3 micrometer, and said resistor layer is made from a carbon dispersed polyimide having a thickness of approximately 100 micrometer.

10. A contact charger according to claim 1, wherein the body to be charged is a photosensitive member provided in an electrophotographic device.

11. A contact charger according to claim 1, wherein said charging member is formed in a roller shape with an outer periphery, a resistor layer being formed on the outer periphery, wherein the resistor layer has the perpendicular resistivity whose order is in the range of between $10^3$ to $10^8\Omega$.

* * * * *